United States Patent [19]

Tollefsen et al.

[11] 4,418,605

[45] Dec. 6, 1983

[54] KEYBOARD FOR MUSICAL INSTRUMENT

[75] Inventors: Kjell T. Tollefsen; Albert W. Nordquist, both of Ivoryton, Conn.

[73] Assignee: Pratt-Read Corporation, Ivoryton, Conn.

[21] Appl. No.: 162,914

[22] Filed: Jun. 25, 1980

[51] Int. Cl.[3] ..... G10C 3/12

[52] U.S. Cl. ..... 84/434; 84/DIG. 7; 200/5 R

[58] Field of Search ..... 84/423 R, 432–437, 84/439, 444, DIG. 7, DIG. 25; 200/5 R

[56] References Cited

U.S. PATENT DOCUMENTS

| | | | |
|---|---|---|---|
| 2,117,002 | 5/1938 | Hammond | 84/423 |
| 2,253,782 | 8/1941 | Hammond et al. | 84/423 |
| 2,844,065 | 7/1958 | Corwin | 84/423 |
| 2,848,920 | 8/1958 | Lester | 84/423 R X |
| 3,110,211 | 11/1963 | Elbrecht | 84/423 |
| 3,173,329 | 3/1965 | Camillucci | 84/434 |
| 3,248,992 | 5/1966 | Wood et al. | 84/436 |
| 3,616,722 | 11/1971 | Hochleitner, Jr. | 84/434 |
| 3,657,460 | 4/1972 | Cutler | 84/DIG. 7 X |
| 3,738,216 | 6/1973 | Slaats et al. | 84/433 |
| 3,911,233 | 10/1975 | Nakamura et al. | 200/5 R |
| 3,911,780 | 10/1975 | Pyle et al. | 84/423 |
| 4,043,244 | 8/1977 | Schrecongost et al. | 84/423 |
| 4,129,057 | 12/1978 | Hoshi | 84/434 |

*Primary Examiner*—Benjamin R. Fuller
*Attorney, Agent, or Firm*—Ratner & Prestia

[57] ABSTRACT

A keyboard for a musical instrument having a frame structure and a plurality of elongated keys. Flat pivot springs are provided for each key and are rigidly held in a vertical position in the frame structure. Each key has a chamber with a lower opening in a rear section for receiving the upper section of an associated pivot spring so that the pivot spring forms the sole pivot about which the key may rotate in a single plane only. The pivot spring is rigidly held in the key chamber in a force fit without the use of a separate fastening device.

34 Claims, 41 Drawing Figures

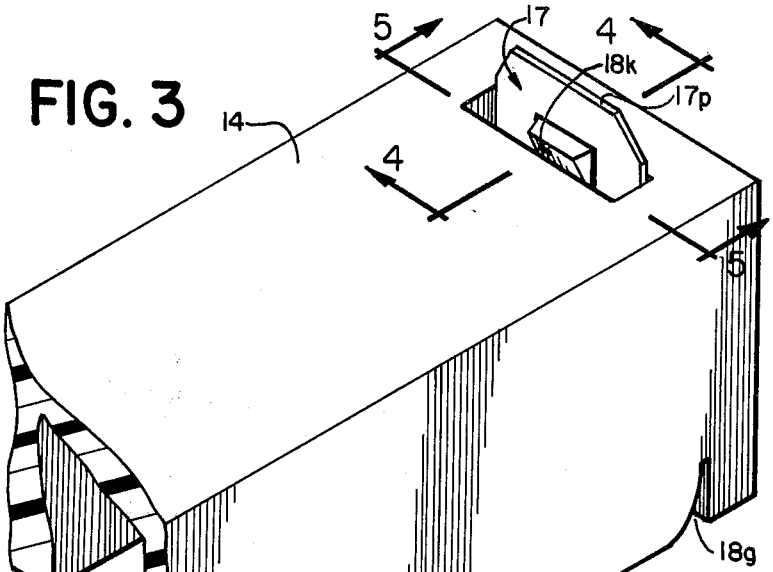
FIG. 3
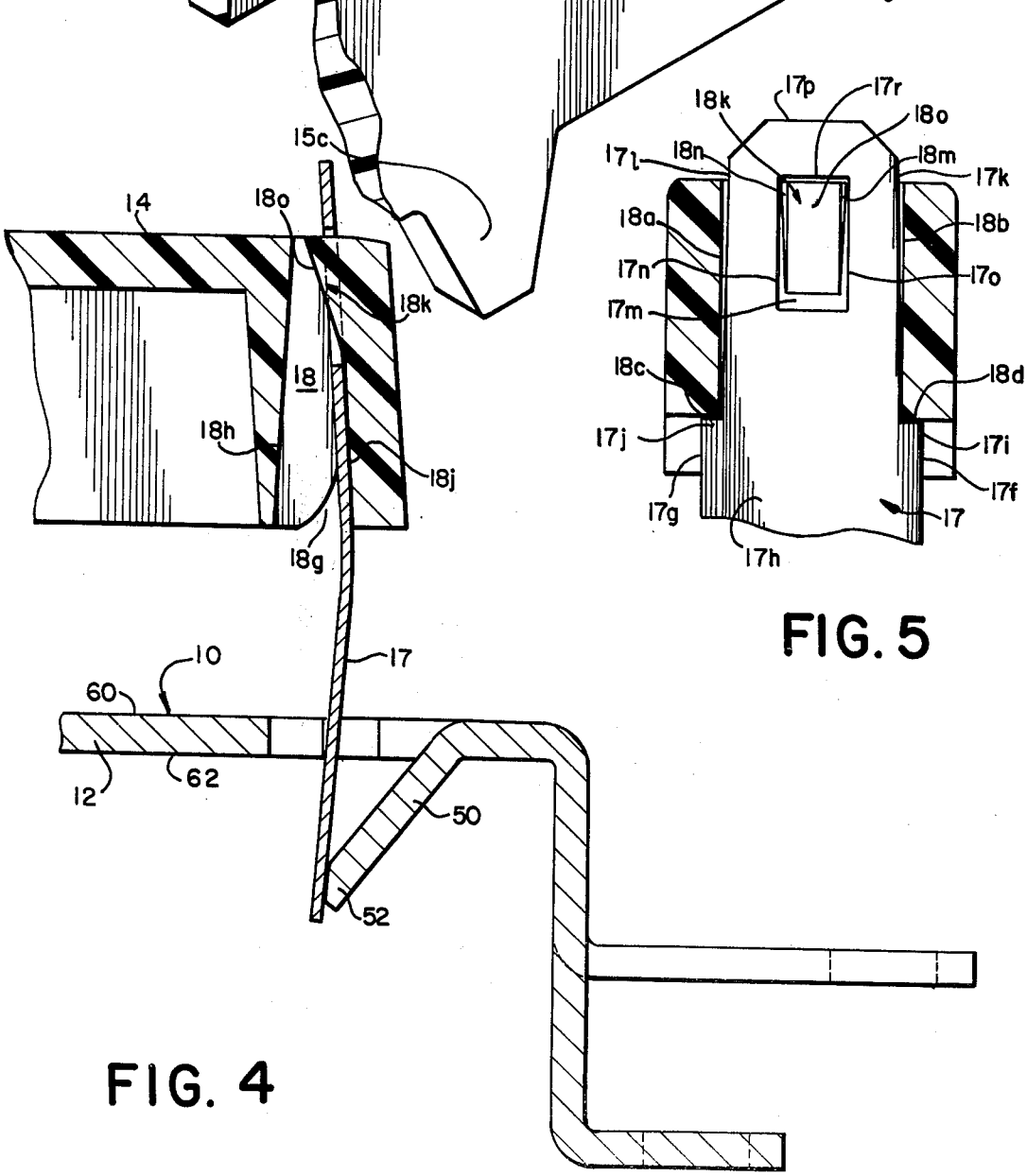
FIG. 5
FIG. 4

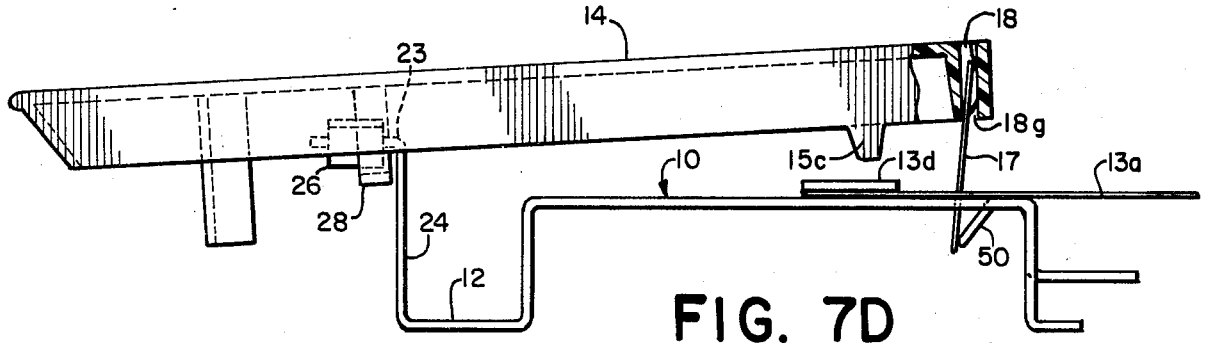
FIG. 7D
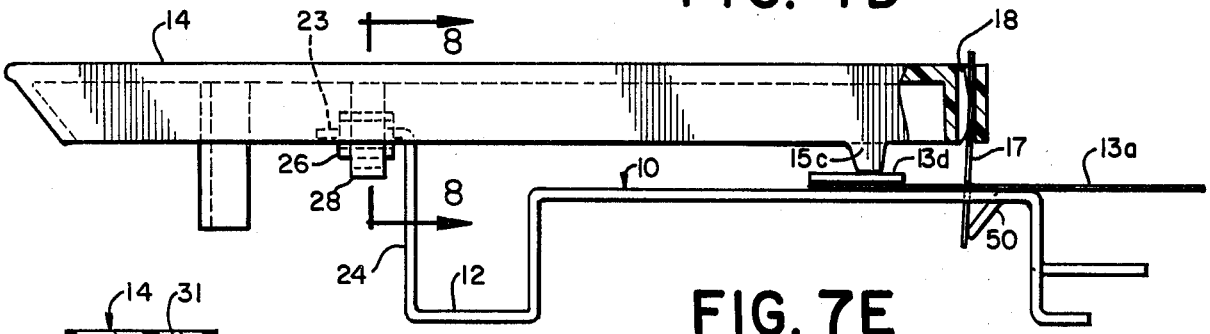
FIG. 7E
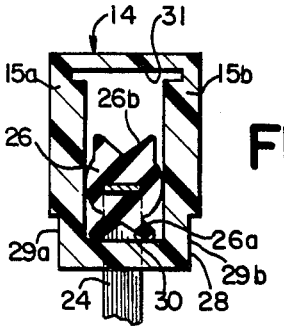
FIG. 8
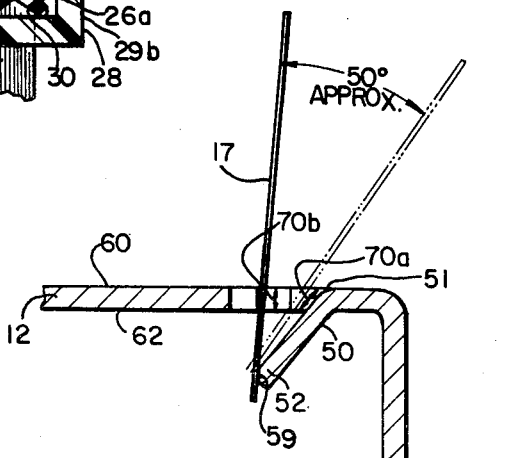
FIG. 9A
FIG. 9
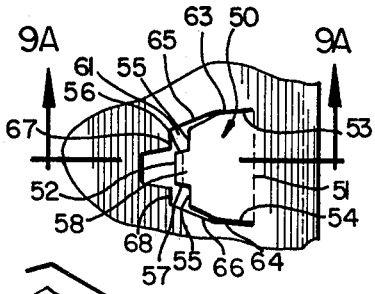
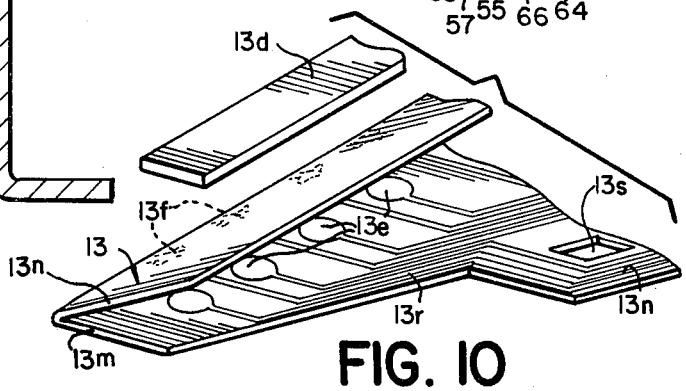
FIG. 10

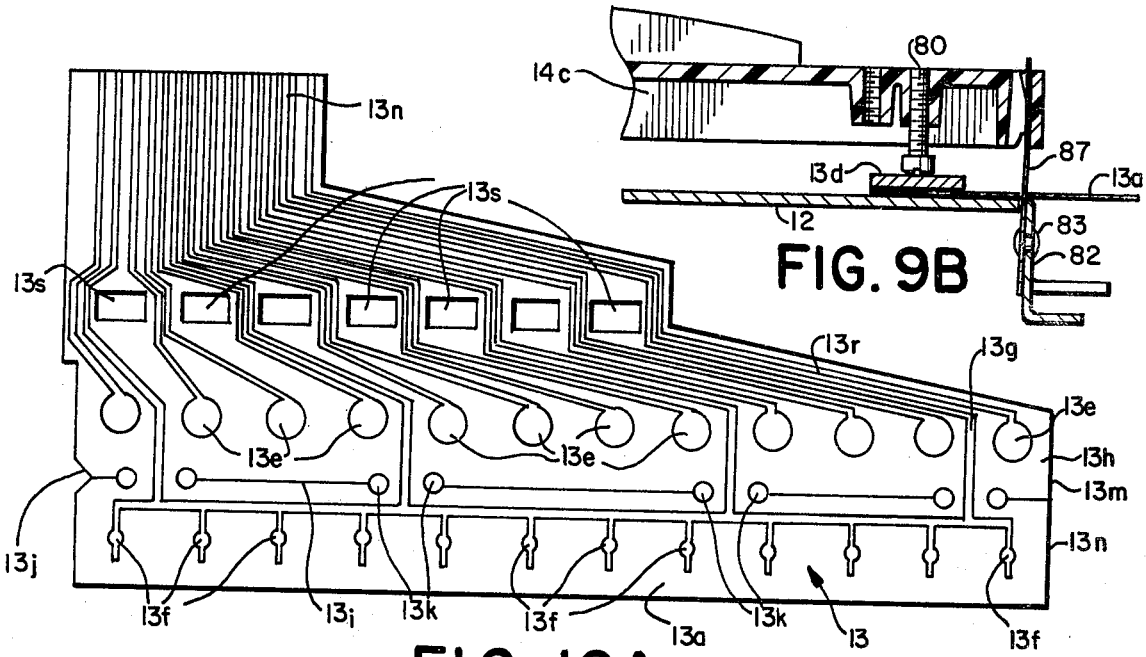
FIG. 9B
FIG. 10A
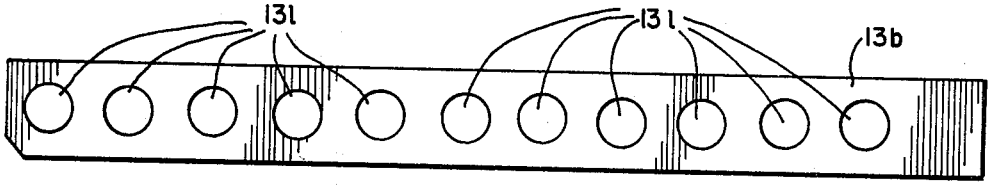
FIG. 10B
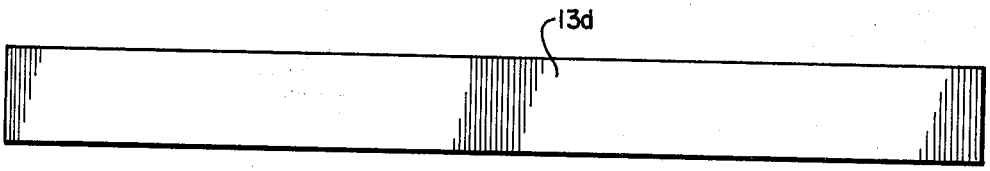
FIG. 10C
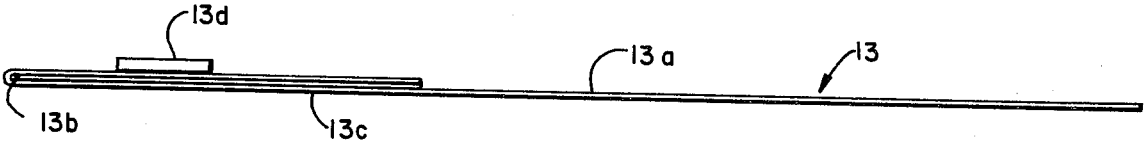
FIG. 10D

KEYBOARD FOR MUSICAL INSTRUMENT

BACKGROUND OF THE INVENTION

A. Field of the Invention

This invention relates generally to the field of key and pivot spring assemblies for musical instrument keyboards.

B. Background Art

Keyboards for electronic musical instruments are well known in which flat springs have been used as the key mounting and biasing elements. In some cases, such as in U.S. Pat. Nos. 3,110,211; 3,616,722 and 3,738,216 individual vertical flat springs or groups of vertical springs formed in comb arrangements have been attached to the keys and/or keyboard chassis by rivets, screws, spotwelds or similar separate fastening devices. The use of these fastening devices has left much to be desired as it has caused problems in the preservation of tolerances. Specifically fastening operations such as punching, riveting, bending, etc. cannot readily be controlled which results in variations from assembly to assembly. Thus, upon installation, each assembly must be adjusted to provide proper clearance of key to switch. In addition, in many cases, fine adjustments have been required after installation all with predictably high labor costs. These methods of fastening have also complicated maintenance or repair procedures—sometimes necessitating removal of an entire section of keyboard to replace or adjust one key or spring.

U.S. Pat. No. 4,129,057 shows a method of employing a flat spring without rivets or screws. However, like most other flat spring arrangements of the prior art, the spring was horizontally disposed (i.e. substantially parallel to the major longitudinal axis of the key). Unfortunately, this disposition does not lend itself readily to resistance to rotational movement about the longitudinal axis of the key.

SUMMARY OF THE INVENTION

A keyboard for a musical instrument having a plurality of elongated keys and a flat pivot spring is provided for each key. A key bed rigidly holds a lower section of each pivot spring. Each key has a lower opening in a rear section for receiving the upper section of an associated pivot spring free of a separate fastening device between key and pivot spring. In this manner the pivot spring extends in a direction generally perpendicular to the key longitudinal dimension to form the sole pivot about which the key may rotate in a single plane only and to resist rotational movement about the longitudinal axis.

Further in accordance with the invention, the key bed has a respective key bed opening for each pivot spring for receiving the lower section of each spring in a rigid force fit relation free of a separate fastening device between pivot spring and key bed.

BRIEF DESCRIPTION OF THE DRAWINGS

FIG. 3 is a perspective view of the rear section of the key installed on the pivot spring of FIGS. 1 and 2;

FIG. 4 is a side elevational section view of the key and spring mounting of FIG. 3 taken along lines 4—4 of FIG. 3;

FIG. 5 is an end elevational section view of the key and upper portion of the spring of FIG. 3 taken along lines 5—5;

FIG. 8 is a detailed elevational sectional view of the stop mechanism taken along lines 8—8 of FIG. 7E.

FIG. 9 is a plan view of a section of keyboard chassis showing the punched out tab of FIG. 4;

FIG. 9A is a cross-section of the chassis showing the tab of FIG. 9 with spring in mounting position;

FIG. 9B is an elevational section view of a further embodiment of the present invention using adjustable screws;

FIG. 10 is a perspective view of the folded-over flexible-membrane circuit board of FIGS. 1 and 2;

FIGS. 10A–10C are plan views of components of the circuit board of FIG. 10;

FIG. 10D is a side elevational view of the circuit board of FIG. 10;

DETAILED DESCRIPTION

Figure 1:
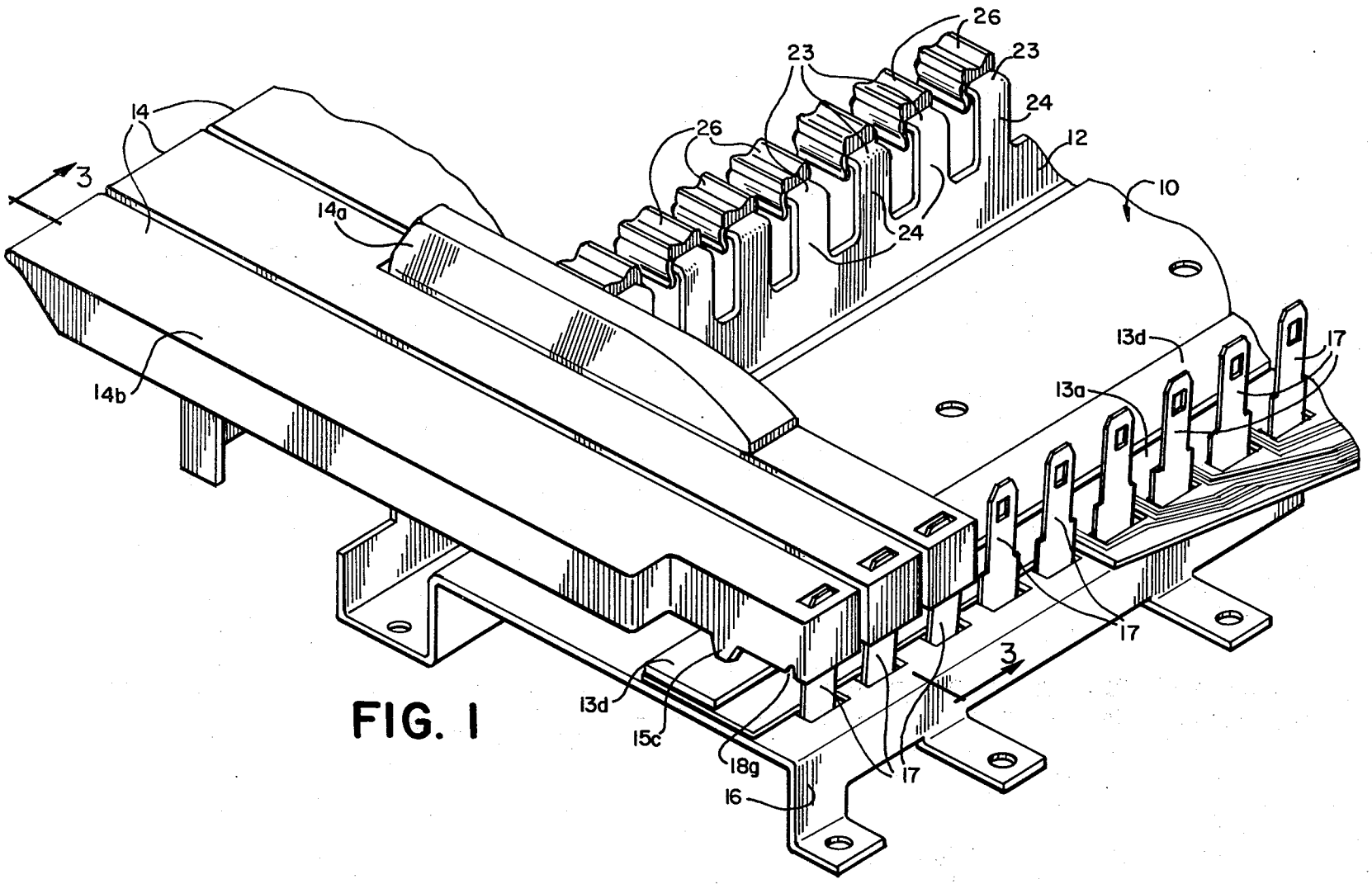
FIGS. 1 and 2 are perspective views showing the keyboard with key spring mounting of the present invention.
Figure 2:
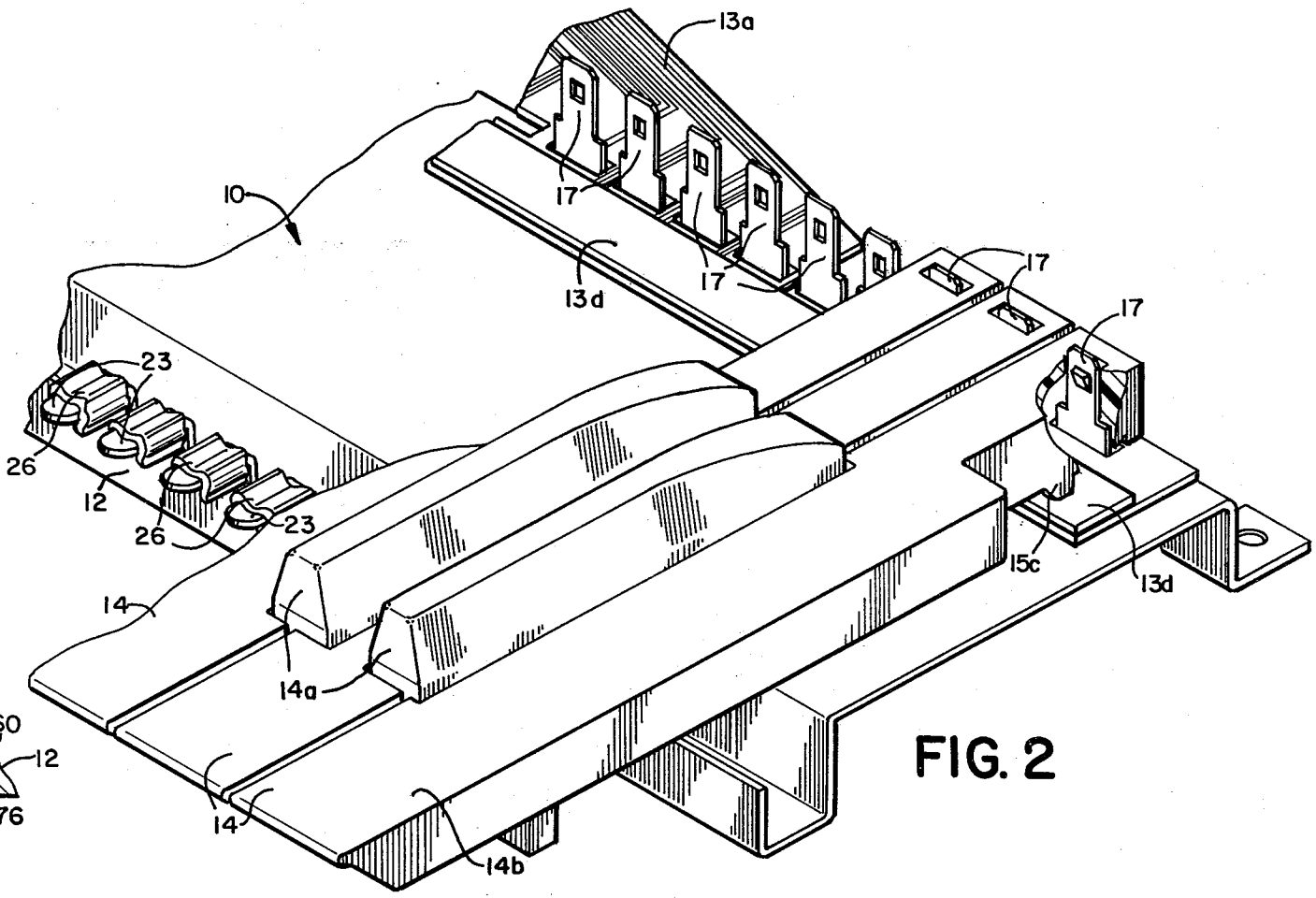

Referring now to FIGS. 1 and 2 there is shown a keyboard 10 comprising a key frame chassis or key bed 12 which supports a plurality of keys 14 and provides a mounting surface for a flexible-membrane circuit board 13 through which electrical circuits are completed when individual keys are depressed. Each of the keys 14 is attached to and pivoted on a substantially vertical pivot spring 17 extending through the top and bottom of a chamber 18 in the key and attached to the rear of the chassis 12 by methods that will be explained later in this description. Spring 17 extends in a direction generally perpendicular to the key longitudinal dimension and provides the sole pivot about which the key 14 rotates.

The keys may be made of a suitable plastic material having longitudinally extending channels 15*a,b* (FIG. 8), with key 14*a* being a sharp key and key 14*b* being a natural key. Since each of the keys, whether sharp or natural, is similarly made, only one of them (referred to as key 14) need be described in detail. A boss 15*c*, FIG. 7C, 7D, formed integrally with channel 15*a* or 15*b* provides the medium through which the related contacts 13*e,f* (FIG. lOA) of the flexible-membrane circuit board 13 are brought together when the key 14 is depressed. An alternative embodiment employs two bosses 15*c,d* (FIG. 3A) in conjunction with an additional set of contacts to provide graduated response to key strokes, velocity sensing, and so forth.

As shown in FIGS. 1, 2, the front section of chassis 12 has for each key an upturned portion 24 with a forwardly extending member 23. Each member 23 has secured thereto a conventional guide bushing or resilient stop 26 of resilient material which is adapted to be engaged by a stop section 28 of the key 14.

As best shown in FIGS. 7D, 7E, 8, stop section 28 is formed integrally with plastic key 14 toward the front end of each key. Each stop section 28 has extending from the key channels 15*a,b* two downwardly directed members 29*a,b* with a transverse stop member 30 extending between the lowermost ends of members 29*a,b*. Member 30 forms an upstop with the lower section 26*a* of stop 26 to limit the upward movement of the front end of each key. To limit the downward movement, an upper stop member (not shown) is formed between channels 15*a,b* for each sharp key 14*a*, while on each natural key 14*b* an inner wall 31 of the top surface of each key operates as down stop with upper stop section 26*b*. Further, the rounded side sections of stop 26 slidingly engage associated inner surfaces of channels 15*a,b*. In this way key 14 is captured to prevent any substantial left to right movement of the key front end while allowing up and down movement thereof.

As best shown in FIGS. 3–6 a hollow chamber 18 is formed toward the rear end of the key 14 without any opening at the rear end of the key. This chamber is of somewhat complex arrangement in that it is designed with a number of slightly tapering dimensions described as follows. First as best shown in FIG. 5, inner side walls 18*a,b* taper outwardly slightly from top to bottom (at about 1½° to the vertical for example) toward the lower shoulders 18*c,d*. Then as viewed in side elevation at FIG. 4, rear end wall 18*j* and front end wall 18*h* are tapered inwardly toward each other from bottom to top (each at approximately 1° to the vertical, as an example).

Figure 3B:
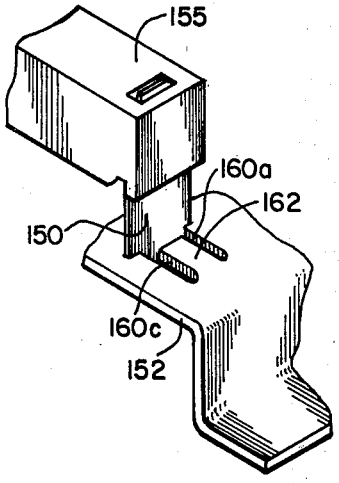
FIG. 3B is a perspective view of the rear section of the key installed on the pivot spring of FIG. 2B.
Figure 3C:
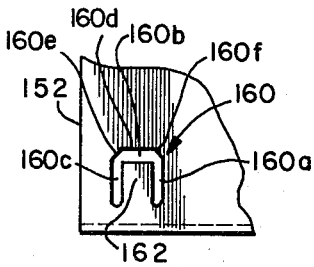
FIG. 3C is a plan view of the rear section of the chassis showing the U-shaped opening and the tab for mounting the pivot spring of FIG. 2B.
Figure 3A:
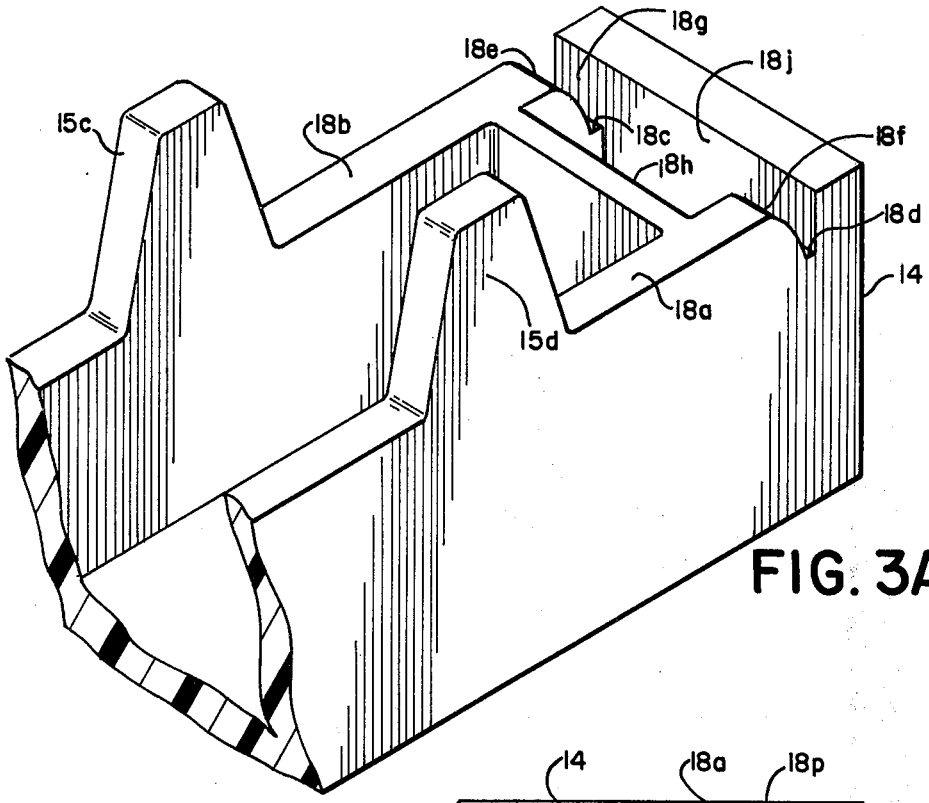
FIG. 3A is a perspective view of the rear section of the key inverted.
Figure 4A:
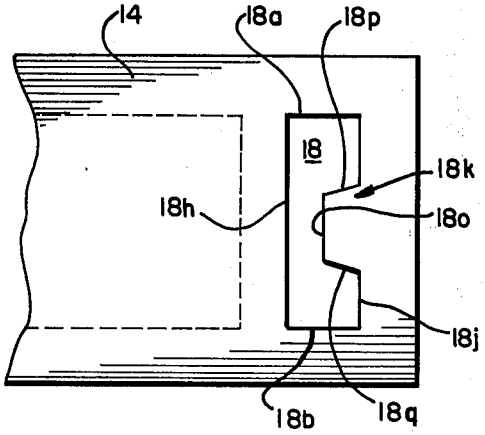
FIG. 4A is a plan view of the rear section of the key.

In addition, a slot 18*g* FIGS. 3A, 4A defined by the rear end wall 18*j*, inner shoulders 18*c,d* and downward facing convex radii 18*e,f* formed in the lower edge of each side wall 18*a,b* is created at the lower rear extremity of the chamber 18. Lower shoulders 18*c,d* are directed transversely to the key longitudinal dimension. Also, a tab 18*k*, with its top surface 181 substantially flush with the top or upper surface 14 of the key, is formed on the rear end wall 18*j* of the chamber. As viewed in end elevation (FIG. 5) the forward edges 18*m,n* of the tab taper slightly inward toward the bottom of the tab. Again as viewed in side elevation (FIG. 4) the face surface 18*o* defined by these edges slopes from its intersection with the top surface 181 to the point where it intersects the vertical surface of the rear end wall 18*j* at an angle (of about 15° to the vertical for example).

Finally, as viewed in plan (FIG. 4A) the flanks or side walls 18*p,q* intersect the rear wall 18*j* and the face surface 18*o* at an included angle of 95° (for example) to give a wedge or tapering effect of (for example) about 5° in the approximately vertical planes of these flanks. These tapering dimensions play an important part in the assembly of the key 14 to the spring 17, as will be explained later. They also have the secondary function of providing draft clearance for withdrawl of the molding core during the key manufacturing process.

Figure 2A:
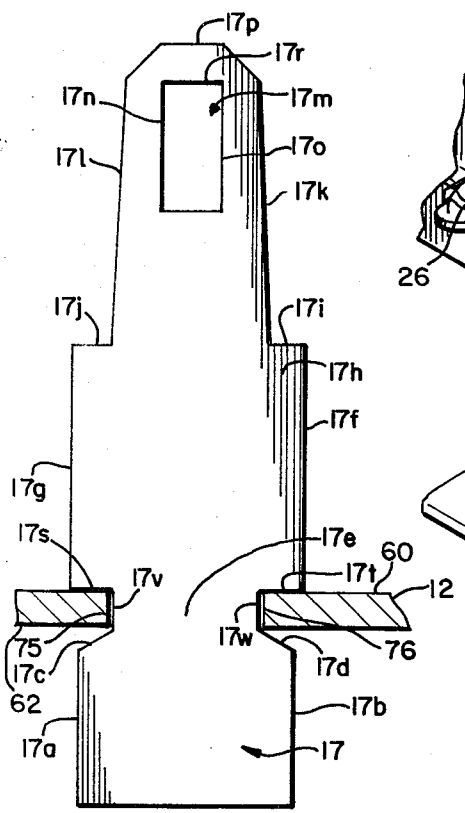
FIG. 2A is an elevational front view of the pivot spring of FIGS. 1 and 2.
Figure 2B:
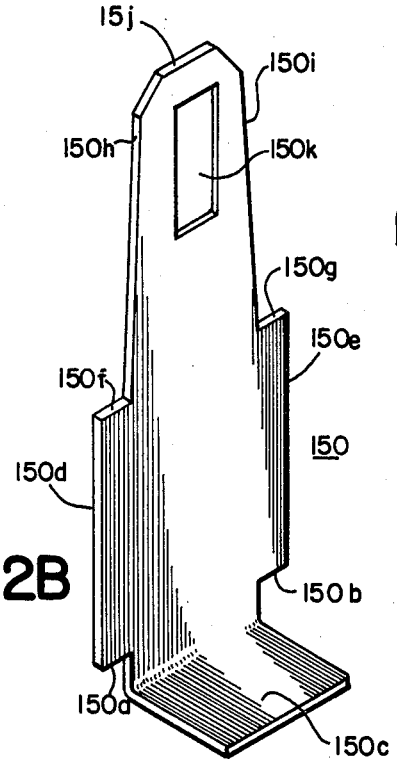
FIG. 2B is a perspective view of the preferred embodiment of the pivot spring of FIGS. 1 and 2.

As already mentioned, the mounting and pivoting medium for each key is a substantially vertically positioned individual spring. FIG. 2A shows the pivot spring is flat throughout its long dimension, and the preferred embodiment of FIG. 2B shows the pivot spring bent at its lower section. In FIG. 2A, the lower section of spring 17 is formed with edges 17*a,b* that rise vertically to lower shoulders 17*c,d*. These shoulders slope inward and upward (at approximately 30° for example), to the horizontal to meet a reduced-width portion 17*e*. From this portion 17*e*, edges 17*f,g* rise vertically to define a center portion 17*h* constituting the maximum width of the spring. This width relative to that of the lower portion 17*a,b* is such that when the spring 17 is being installed in the chassis 12, as later described, the lower portion 17*a,b* can pass freely through an opening 61 punched in the chassis 12, but this center section 17*h* cannot. This section terminates in upper shoulders 17*i,j* from which edges 17*k,l* continue upward at a slight inclination or taper toward each other (for example 2° to the vertical). This taper is designed to make contact or provide a slight interference fit with the lower portion of the reverse taper in the key chamber. A cutout 17*m* is formed toward the upper extremity of the spring 17; the edges 17*n,o* defining the major dimension of the cutout are vertical and parallel.

The preferred embodiment of the pivot spring is shown in FIG. 2B. As shown, pivot spring 150 provides a mounting and pivoting medium for each key which is similar to the spring shown in FIG. 2A. Spring 150 is a substantially vertically positioned individual spring which is flat throughout most of its long dimension having a bend in a rearwardly direction of approximately 90° with respect to its long or vertical dimension. The lower section of the spring is formed of two portions. A first upper portion having an extended transverse dimension, is formed with edges 150*d,e* that rise vertically to shoulders 150*f,g* of the upper section. The other portion, 105*c*, has a reduced transverse dimension 150*a,b* which is bent slightly below shoulder 150*a,b* in a rearwardly direction in approximately 90° with respect to the first portion.

The upper section of spring 150 is substantially similar to the upper section of spring 17 shown in FIG. 2A. Thus, shoulders 150*f,g* of spring 150 are similar to shoulders 17*i,j* of spring 17; edges 150*h,i,j* of spring 150 are similar to edges 17*l,k,p* of spring 17, respectively; and cutout 150*k* formed toward the upper extremity of spring 150 is similar to cutout 17*m* of spring 17. The edges defining the major dimension of cutout 150*k* are vertical and parallel. The taper formed by edges 150*h,i* is also similar to the taper formed by edges 17*l,k* and is designed to make contact or provide a slight interference fit with the lower portion of the reverse taper in the key chamber. Finally, edges 150*d,e* formed between upper and lower shoulders 150*f,g* and 150*a,b*, respectively, are similar to edges 17*g,f* of FIG. 2A.

The manner in which spring 17 is attached to chassis 12 is described as follows with respect to FIGS. 9, 9A. For each key position a tab 50 is punched downward from the horizontal surface 60 of the chassis 12 to assume an angle of about 50° (for example) to the said horizontal surface. As best seen in FIG. 9 the shape of the plane surface of the tab (and of the corresponding opening in the chassis) is most easily described as a series of three truncated triangular sections arranged to taper in steps from the fold line 51 to the forward tip 52. That is to say, starting from the said fold line the tab edges 53,54 taper towards each other at a small angle (7° for example) to a point approximately one-third the distance to the tip, where they assume a greater angle of taper (25° for example) for a further third of the tab length, at which point they intersect a shoulder 55 formed parallel with the fold line 51. From the shoulder the edges 56, 57 of a reduced-width section 58 again taper toward each other at a lesser angle (11° for example) to the point where they intersect the tip 52 of the tab, formed parallel to the fold line 51. Finally, as viewed in side elevation (FIG. 9A) the top leading edge 59 of the tip 52 is machined or formed to provide a surface forming an approximate angle of 85° (for example) to the upper horizontal surface 60 of the key bed or chassis 12.

The sequence for installing the spring 17 in the keyboard chassis 12 and subsequently installing the key 14 on the spring 17 is best understood by referring to the series of FIGS. 7 through 7E. First, the spring 17 is oriented to lie in the same plane as the tab 50, (FIG. 7), then it is inserted through the tab opening 61 FIG. 9 from above (FIG. 7A) so that it slides down the tab until the lower sloping shoulders 17*c,d* (FIG. 2A) of the spring 17 lie flush with, or slightly below, the lower horizontal surface 62 of the chassis 12. The spring is then rotated forward (FIG. 7B), causing the 90-degree (spring transversely directed) shoulders 17*s,t* to engage the tapered edges 63, 64 of upper horizontal surface 60 of the chassis 12, while the lower sloping shoulders 17*c,d* engage the corresponding edges of the lower horizontal surface 62. In this rotational movement the 50° angle at which the spring is forced to attack the opening 61 in the chassis creates a toggle or ramping effect (as viewed in side elevation, FIG. 9A) as the upper shoulders 17*s,t* and lower shoulders 17*c,d* are forced to accommodate to (in effect) varying dimensions 70*a* and 70*b* of the chassis thickness. At the same time as spring 17 approaches the vertical position it encounters the increased taper of the edges 65,66 until finally it comes to a hard stop against the shoulders 67, 68 of the tab opening 61. The width of the tab opening 61 at the forward shoulders 67, 68 is approximately 0.005 inch greater than that of the contacting spring section 17*e*, so that the security of spring 17 location does not depend on an interference fit between the vertical edges 17*v,w* of this section 17*e* and the vertical edges 75, 76 (FIG. 2A) of the chassis tab opening 61. In other words, it is the geometry of the rotational arc through which the spring 17 is forced to travel (as it pivots about the tab tip 59) that acts in conjunction with the tapers of both the lower shoulders 17*c,d* of the spring 17 and the horizontal edges 65,66 of the tab opening 61 to create a positive wedging or force fit as the spring assumes its final position (some 5° for example) short of the vertical (FIG. 7B). In this manner spring 17 is held at a substantially small angle short of the vertical away from the key front. The small angle serves to preload the spring when the key 14 is installed; this preloading fulfills several functions: first, it retains the key in the off or up position, then it ensures the spring will remain firmly against the rear wall 18*j* of the key chamber 18, and finally, it keeps the lower section between sides 17*a,b* of the spring pressed against the tab 50, to secure the spring securely to the chassis 12.

The sequence for installing the key 14 on the spring 17 is then as follows (refer to FIGS. 7C through 7E ).

Figure 7F:
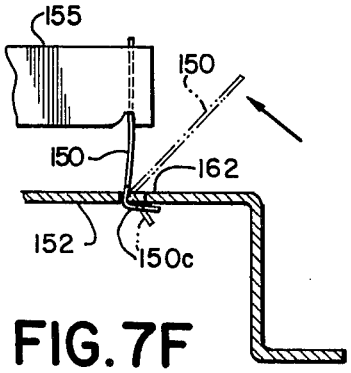
FIG. 7F is an elevational section view of the keyboard assembly of FIGS. 1 and 2 showing steps in installation of the pivot spring of FIG. 2B and the key.
Figure 7G:
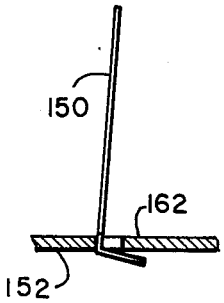
FIG. 7G is an elevational section view of the pivot spring of FIG. 2B mounted in the U-shaped chassis opening before installation of the key.
Figure 7H:
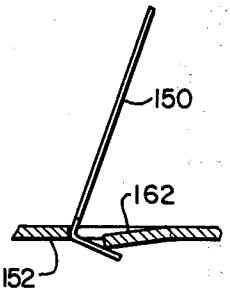
FIG. 7H is an elevational section view of the pivot spring of FIG. 2B mounted in the U-shaped chassis opening showing the top of the pivot spring displaced rearwardly using an adjustable chassis tab depression angle.
Figure 6:
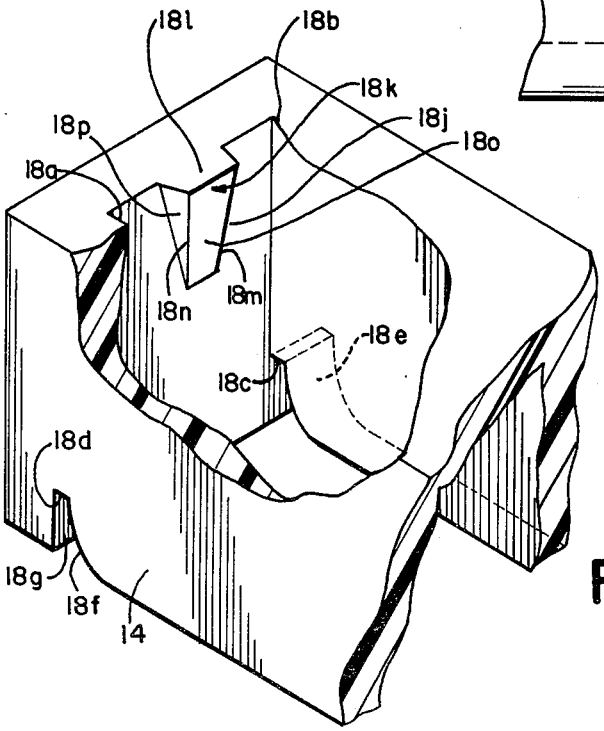
FIG. 6 is a cut-away perspective view of the rear key section of FIG. 3.
Figure 7:
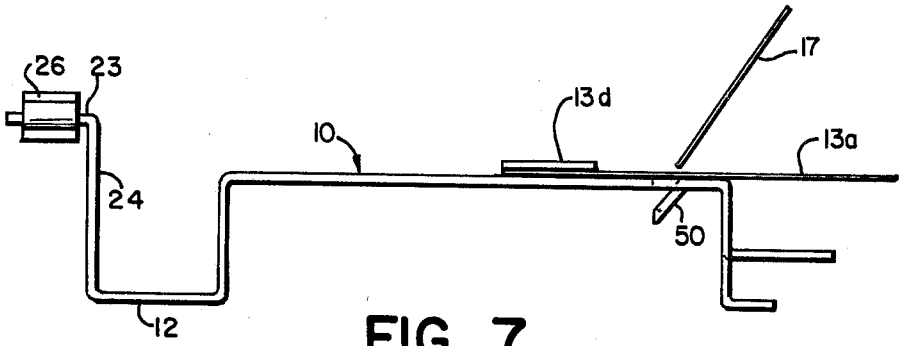
FIGS. 7–7E are elevational section views of the keyboard assembly of FIGS. 1 and 2 showing steps in installation of the key and spring.
Figure 7A:
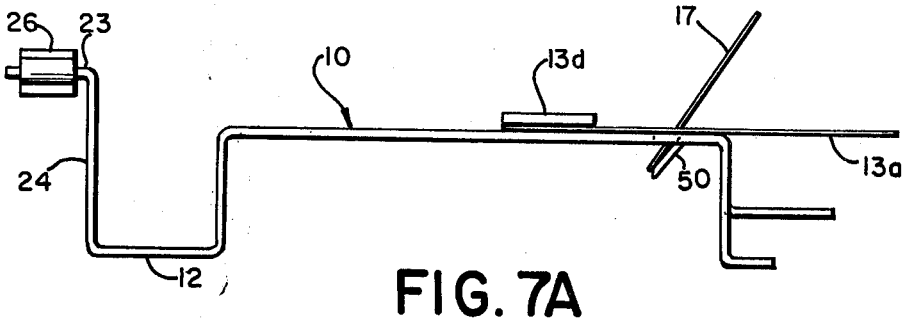
Figure 7B:
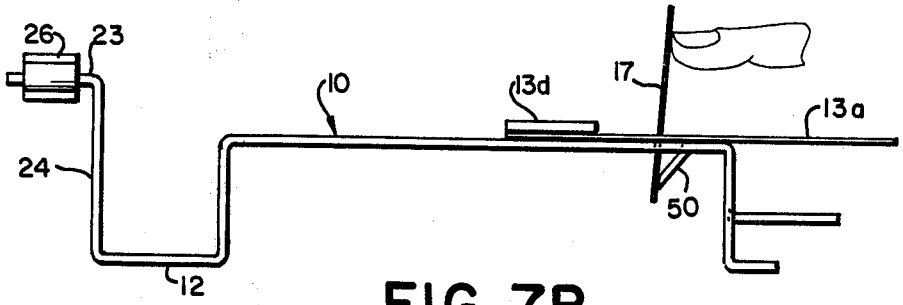
Figure 7C:
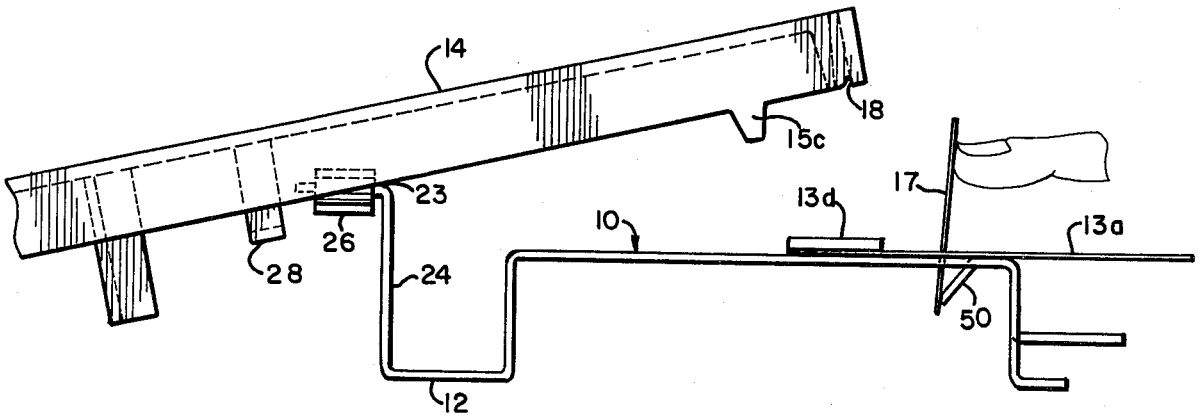

First the key 14 is oriented to the keyboard chassis 12 as shown in FIG. 7C so that the stop section 28 engages with the stop 26 while the rear end of the key embodying the chamber 18 is positioned above the spring 17. Finger pressure applied to the spring to bias it toward the front of the keyboard permits the spring to enter the slot 18*g* (FIG. 6) in the chamber 18, as shown in FIG. 7D. Downward pressure applied to the rear end of the key forces the tapered edges of the spring 17*k,l* (FIG. 5) into increasingly intimate contact with the lower portion of the key internal side walls 18*a,b* (FIG. 5). At the same time the upper edge of the spring 17*p* slides over the tab 18*k* until finally the top edge of the slot 17*r* snaps over the top face 18*l* of the tab while the transversely directed spring shoulders 17*i,j* simultaneously engage the lower shoulders 18*c,d* of the side walls 18*a,b*. It will be appreciated that the metal edges 17*k,l* of the spring will scrape into and tend to slightly groove the softer plastic of the key as they are forced into a rigid interference fit with the tapered inner side walls 18*a,b*. For example, this may be in a range of zero to five thousands inch interference fit as a function of the tooling tolerance. The same will be true of the engagement of the tab 18*k* with the spring slot 17*m*, resulting in a very positive attachment of the key to the spring. Specifically, the vertical edges 17*n*, 17*o* of slot 17*m* make increasingly intimate contact with the tapered flanks 18*p*, 18*q*. As best shown in FIG. 5, dimensions and slopes of the vertical edges 17*k*, 17*l* of the spring 17 the vertical edges 17*n,o* of the spring slot 17*m* are correlated with those of the contacting surfaces of the key chamber inner walls 18*a*, 18*b* and tab 18*k* to provide increasing force fit, culminating in the spring slot's snapping home over the tab 18*k* simultaneously with the spring shoulders 17*i,j* coming into hard contact with the inner shoulders 18*c*, 18*d* of the key walls.

This method of mounting the key confers several important benefits. First, there is a high degree of resistance to rotational movement or slop about the longitudinal axis of the key—always a problem in the design of keyboard mechanisms. This rotational resistance about the longitudinal axis results from the relatively large separation distance between the points of contact of spring shoulders 17*i,j* with key shoulders 18*c,d* and points of contact of edges of spring slot 17*n,o* with key tab flanks 18*p,q*. That is to say: rotational movement in the counterclockwise direction (as viewed in FIG. 5) is resisted by the combination of spring shoulder 17*j* contacting key shoulder 18*c* and top of slot edge side wall 17*n* contacting top of tab flank 18*p* (FIGS. 4A,6). Likewise, clockwise rotation is resisted by the combination of spring shoulder 17*i* contacting key shoulder 18*d* and top of slot edge side wall 17*o* contacting top of tab flank 18*q*.

Then the spring's natural stiffness also strongly resists movement in the longitudinal direction while providing the return bias required to keep the key 14 in the off or at-rest position. Finally, this mounting method, by obviating requirements for riveting, punching holes in springs, or making other attachments to the key or chassis greatly simplifies the problem of maintaining tolerances. It reduces the requirement to that of maintaining the dimension between the horizontal chassis surface 60 and the point where the spring upper shoulders 17*i,j* contact the key shoulders 18*c,d*. The tool for forming spring 17 may be accurately controlled as well as the injection mold of key 14. Accordingly, since switch 13 is on surface 60, the tolerance of key member 15*c* to switch 13 may then be accurately controlled. All this is achieved while still offering the benefits of very simple installation and removal—easily accomplished without tools.

It will now be understood that the rigid coupling between spring 17 and key 14 is free of a separate fastening device such as a screw, rivet or weld. The coupling is provided only by the key and spring themselves which provides the above described force or interference fit.

The removal procedure consists merely of pushing the protruding top edge of the spring 17 toward the front of the keyboard 10 with one finger to disengage the spring slot 17*m* from the tab 18*k* while simultaneously lifting the rear end of the key 14 off the spring and subsequently disengaging the key from the stop 26. Similarly, the procedure for removing the spring 17 from the chassis 12 consists simply of pressing the upper portion of the spring toward the rear of the chassis until the shoulders 17*s,t* clear the tapered edges 63,64 of the tab opening 61 (FIG. 9) and then withdrawing the spring 17 upward through the opening.

Having described the manner in which spring 17 is attached to the chassis and subsequently to the key, it will now be easy to understand the manner in which spring 150 of FIG. 2B is attached to the chassis and subsequently to the key. For each key position a tab 162, shown in FIGS. 3B and 3C, is punched from the horizontal surface of chassis 152. As best seen in FIG. 3C, the shape of tab 162 is substantially rectangular. Formed forward and to the sides of tab 162 is key bed opening or chassis tab opening 160, having center portion 160*b* formed forward of tab 162 and rearward extending leg openings 160*a,c* formed to the sides of tab 162. Center opening 160*b* and leg openings 160*a,c* are similar in width (1 1/16th inch for example), each forming parallel edges on tab 162 and chassis 152. Forward chassis edge 160*d* meets the outermost edges of leg openings 160*a,c* by way of chassis tapers 160*f,e* respectively. Chassis tapers 160*f,e* each form a 45° angle (for example) with respect to forward chassis edge 160*d*. The importance of these tapers will be readily understood from the following description of the manner in which spring 150 is attached to chassis 152.

The sequence for installing spring 150 in the chassis is best understood by referring to FIGS. 7F and 7G. First, spring 150 is tilted rearward to permit the reduced transverse portion 150*c* to pass through center opening 160*b* of chassis tab opening 160. It is permitted to pass through the opening until shoulders 150*a,b* of spring 150 come to rest on the upper surface of chassis 152, said shoulders being wider than the chassis tab opening 160*b*. The spring is then rotated forward (FIG. 7F), causing the surface of the spring directed to the front to engage forward edge 160*d*. It will be understood that forward edge 160*d* is slightly larger than the width of section 150*c* (0.260 inch versus 0.250 inch, for example). Tapers 160*f,e* provide guides for aligning and tending to center section 150*c* for engagement with forward edge 160*d*. The spring rotates forward until the top surface of portion 150*c* meets the lower surface of tab 162. In this rotational movement, spring 150 comes to rest in an almost vertical position, however, still inclined (towards the rear) from the vertical position by approximately 5° (for example), as shown in FIG. 7G.

In this manner, spring 150 is held at a substantially small angle short of the vertical away from the key front. The small angle serves to preload the spring when key 155 is installed. This preloading fulfills several functions: first, it retains the key in the off or up position, then it ensures the spring will remain firmly against forward edge 160*d*, and finally, it keeps portion 150*c* of the spring pressed against tab 162, to secure the spring firmly to chassis 152. It will also be understood that shoulders 150*a,b* of the spring tend to dig into the top surface of chassis 152, since the spring is made of stainless steel and the chassis of substantially soft steel. This further secures the spring firmly to chassis 152. It will also be understood that with key 155 (FIG. 7F) installed on spring 150 any backward movement on part of the spring will tend to increase the preload tension and consequently further hold spring 150 in position.

The sequence for installing key 155 on spring 150 is similar to the sequence for installing key 14 on spring 17 and has already been described. The removal procedure of key 155 is also similar to that described earlier.

It will be understood that the 90° bend in spring 150 is made by a stamping tool and may be easily controlled. The stamp is made so that the dimension from the top surface of reduced transverse portion 150*c* to the shoulders 150*a,b* of spring 150 is slightly less (0.003" for example) than the thickness of chassis 152. The combination of these described dimensions provides that spring 150 in its free standing position is tilted toward the rear by 5° (for example) from the vertical, as described earlier. It will now be understood that the rigid coupling between spring 150 and key 155 is free of a separate fastening device, such as a screw, rivet or weld. The coupling is provided only by the key, spring and the chassis tab opening. All this is achieved while still offering the benefits of very simple installation and removal-easily accomplished without tools.

Thus, the preferred embodiment of spring 150 of FIG. 2B and tab 162 of FIGS. 3B,C provide a reliable and simple way of maintaining tolerances when making and installing pivot spring 150. As described earlier, spring 150 in its free standing position is tilted toward the rear by 5° (for example) from the vertical. This occurs when the top surface of tab 162 is level or flush with the top surface of chassis 152, as shown in FIG. 7G. However, by depressing tab 162 it is possible to increase the preload tilt of spring 150. Conversely, raising the tab reduces the preload tilt or bias on spring 150. This is shown in FIG. 7H. Thus, individual keys may be adjusted if this preload is faulty or it is desired to have a line of instruments having a "touch" which is heavier or lighter than normal.

Switching assemblies for electronic musical instruments are described in detail in patent application Ser. No. 895,615 for Keyboard for Electronic Musical Instrument by A. H. Lehmann, filed Apr. 12, 1978 and assigned to the same assignee as this application and now abandoned.

The flexible-membrane circuit board 13 for the switching assembly is best shown in FIGS. 10–10D and is made up of a deformable sheet material such as polyester film folded over an insulating material in such a manner as to form a set of switch contacts, upper movable elements of which are forced into contact with the lower fixed elements when the related keys are depressed.

The assembly 13 is formed in a sandwich construction that comprises four parts only: the fold-over membrane 13*a*, an insulated spacer 13*b*, and adhesive backing strip 13*c*, and a strip of resilient material such as "Poron" cellular urethane 13*d* made by Rogers Corp., E. Woodstock Conn. As best shown in FIG. 10A the fold-over membrane 13*a* comprises a substrate 13*h* of deformable dielectric material having a pattern of contact elements 13*e,f*, and connector traces 13*g* on its top surface. Contact elements and connectors may be formed on substrate 13*h* by well known techniques. For example, an electrodeposited copper surface may be etched, using photoresist material, to provide the conductive element configuration. The copper traces thus formed are then plated with a tin/lead alloy to provide the desired elements. A fold line 13*i*, is defined by a V-notch 13*j* and a number of ⅛-inch (for example) holes 13*k*. When the membrane 13*a* is folded about this line so that the contacts face each other, the contacts 13*e* on the major portion 13*m* then form the fixed contacts, while the contacts 13*f* (typical) on the minor folded-over portion 13*n* then form the moving contacts. The insulated spacer 13*b* (FIG. 10B) is constructed with holes 13*l* slightly larger than the fixed contacts 13*e*, so that when the spacer is inserted between the folded sections of the membrane 13*a*, the movable contacts 13*f* can be brought into contact with the fixed contacts 13*e* by pressure applied to the movable contacts. The strip of resilient material 13*d* (FIG. 10C) is then attached by adhesive means to the folded-over (minor) portion 13*n* of the membrane immediately over the contact area (FIG. 10). This material has the function of providing "feel" or resistance to downward actuation of the keys and also of absorbing any remaining travel of the key actuator boss 15*c* after the moving contact 13*f* has been brought into contact with the fixed contact 13*e*, thereby avoiding crushing of the contacts or membrane.

Depression of a key 14 therefore applies force through its actuator boss 15*c* to the resilient material 13*d*, which in turn deforms the folded-over portion 13*n* of the membrane in the area immediately below the actuator boss, causing the related moving contact 13*f* to be deformed downward through the hole 13*l* in the insulated spacer 13*b* to electrically connect with the fixed contact 13*e* on the major portion 13*m* of the membrane circuit board. Upon release of the key, the resilient material 13*d* immediately springs back to its original undeformed shape, permitting the movable contact 13*f* to retract from the fixed contact 13*e*, thereby breaking the circuit. Connecting printed wiring 13*r* and 13*g* formed integrally with the fixed and moving contacts 13*e* and 13*f*, respectively, couple the electrical signals to the tail end 13*n* of the membrane circuit board 13, where they may connect to a printed circuit board or other circuitry by means of an edge connector or individual leads, etc. It will be understood that board 13 may be aligned on the chassis by means of aligning fingers extending through the chassis and into openings 13*s*.

Figure 11:
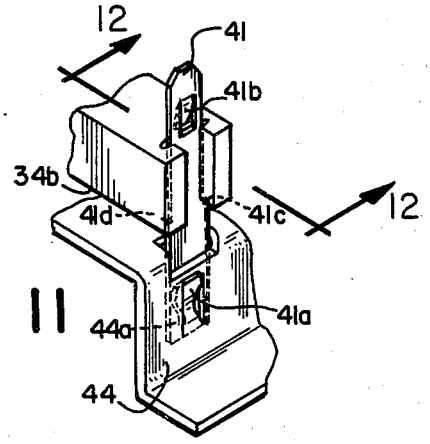
FIGS. 11, 13, 15, 17 and 19 are perspective views of further embodiments of the key spring mounting of the present invention.
Figure 12:
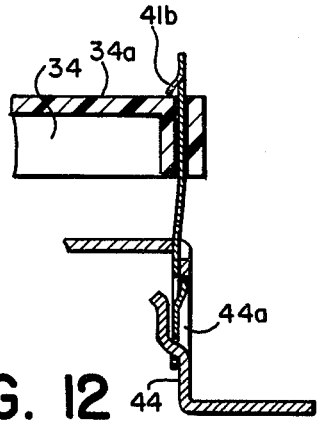
FIGS. 12, 14, 16 and 18 are elevational sectional views of the embodiments of FIGS. 11, 13, 15 and 17 respectively.

Other embodiments of the pivot spring are shown in FIGS. 9B and 11–12. FIG. 9B shows an embodiment in which an adjustable screw 80 is substituted for the key boss 15*c* and provision is made for a second adjustable screw that would depress a second movable contact if so desired. In this embodiment a method of securing the spring 87 to the chassis 82 by means of a rivet 83 is also shown.

Figure 13:
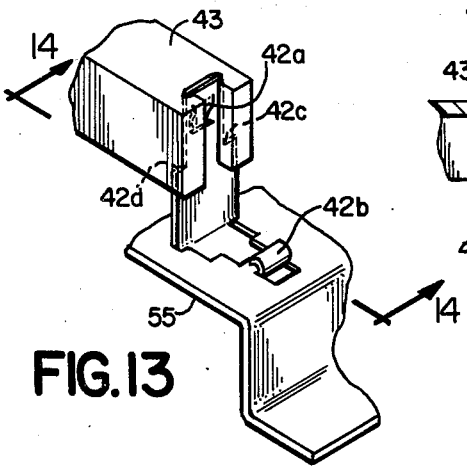
Figure 14:
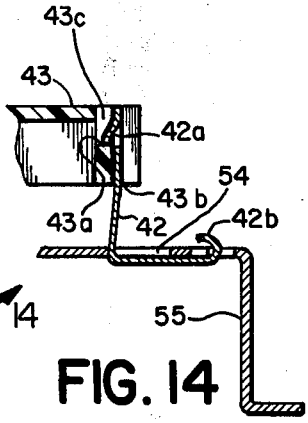

FIGS. 11 and 12 show an arrangement in which the lower end of the spring 41 is anchored to the vertical section 44 of the keyboard by means of a tab 41*a* which snaps into a slot 44*a* provided in the vertical section 44 of the keyboard chassis. Another tab 41*b* formed on the upper end of the spring snaps out to make contact with the upper surface 34*a* of the key 34 thereby anchoring the key securely to the spring. Shoulders 41*c,d* formed on the upper end of the spring 41 contact the lower surface 34*b* of the key to locate the key positively (in conjunction with tab 41*b*) in the vertical plane. FIGS. 13, 14 show a spring 42 with a tab 42*a* formed at its upper end which snaps out to engage a ledge 43*a* formed in a chamber 43*b* in the key 43. The chamber, which extends for approximately half the depth of the key is dimensioned to permit the spring tab 42*a* to snap out to engage the ledge 43*a* when the spring 42 emerges from a slot 43*c* located immediately below the chamber 43*b*, as the key 43 is pressed down over the spring 42. An upturned end 42*b* on spring 42 engaging a slot 54 in the keyboard chassis 55 anchors the spring to the chassis 55. Lower shoulders on spring 42 engage the upper surface of chassis 55 adjacent slot 54. These shoulders provide lateral stability and prevent spring 42 from falling through chassis 55. Shoulders 42*c,d* formed on the upper portion of the spring 42, act in conjunction with the tab 42*a* to locate the key positively in the vertical plane.

Figure 15:
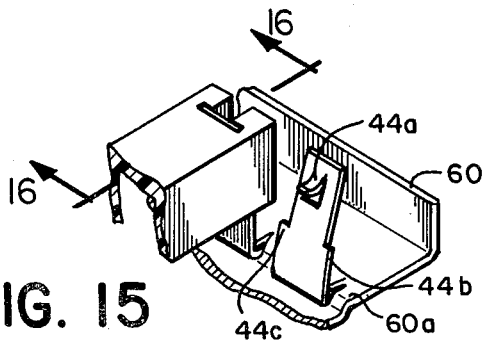
Figure 16:
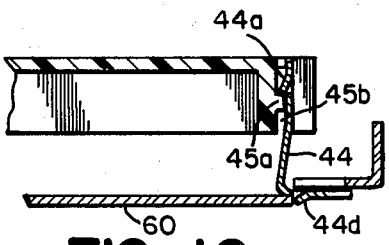

FIGS. 15, 16 show another variation of the embodiment of FIGS. 13, 14. Again the upper tab 44*a* of spring 44 engages a ledge 45*a* formed within a chamber 45*b* of the key 45 and, again, shoulders 44*b,c* formed on the upper portion of the spring 44 act in conjunction with the tab 44*a* to locate the key 45 positively in the vertical plane. The lower end of the spring 44 is equipped with a tab 44*d* that engages a slot formed in a horizontal section 60*a* of the keyboard chassis 60.

Figure 17:
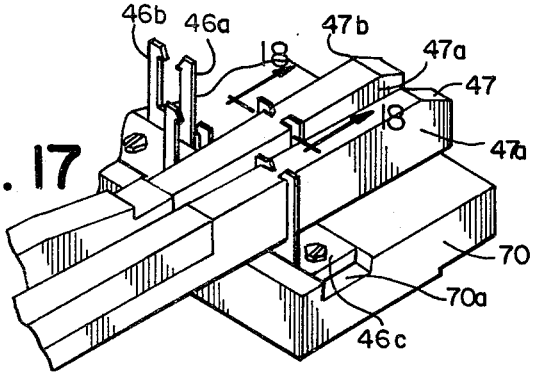
Figure 18:
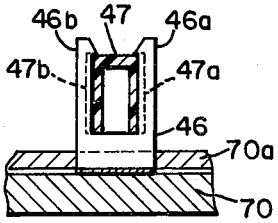

FIGS. 17, 18 show an embodiment in which the upper portion of spring 46 is formed in a U-shape so that the ears 46*a,b* are snapped into slots in the side walls 47*a,b* of the key 47. The lower portion 46*c* of the spring 46 is fastened to a horizontal section 70*a* of the keyboard chassis 70.

Figure 19:
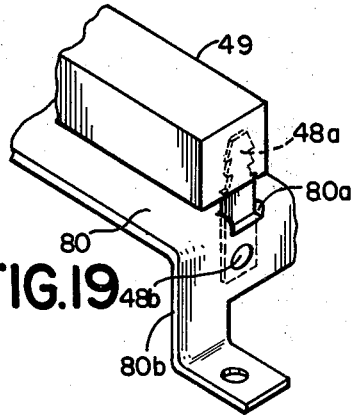

Finally, FIG. 19 shows an embodiment in which the upper portion 48*a* of the spring 48 is formed in a fir tree or serrated shape so that the spring can be permanently attached to the key 49 during the key molding process or later by force fit.

A lower section of spring 48 extends into a slot 80*a* formed in section 80*b* of chassis 80. The lower spring section may be rigidly secured in place to chassis section 80*b* by fastening means 48*b* such as a rivet, spot welding, a screw or the like. The close tolerances between the edges of slot 80*a* and the sides of spring 48 prevent rotation.

Figure 20:
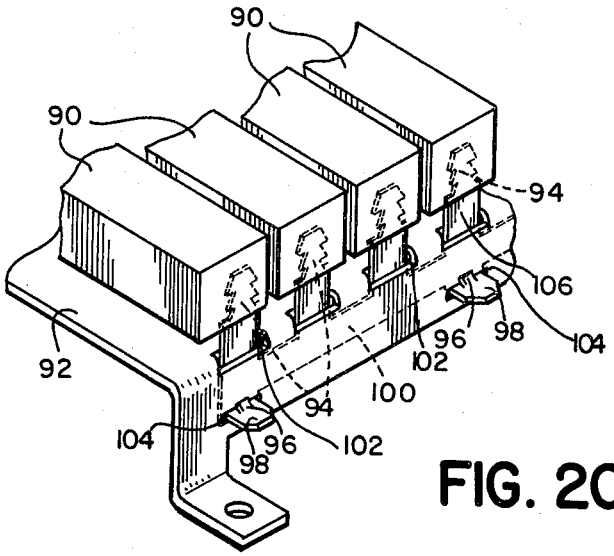
FIGS. 20 and 21 are perspective views of still further embodiments of the pivot spring.
Figure 21:
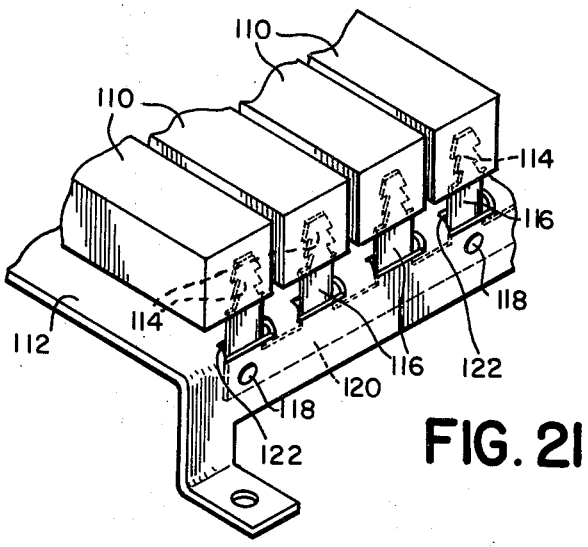

Still further embodiments are shown in FIGS. 20 and 21 in which the pivot springs are formed in a comb-like arrangement which provides excellent lateral stability. Specifically, as shown in FIG. 20, vertical pivot springs 106 are formed integrally with a horizontal section to define a comb-like assembly 100. Vertical pivot springs 106 extend through upper openings 102 of chassis 92. Assembly 100 has extending from a lower section a pair of tabs 98 which are bent to horizontally pass through openings 104 in chassis 92. Each of tabs 98 has a biased barb 96 which snaps out upwardly to engage the back outer wall of chassis 92 locking the comb spring assembly 100 in position by force fit. It will be understood that as illustrated two of such tabs 98 may provide sufficient structural integrity for the entire comb assembly 100. After assembly 100 is secured in place on chassis 92, keys 90 are assembled onto the fir shaped upper ends 94 of pivot springs 106. In this manner there is achieved a key and pivot spring assembly with substantially no rotational movement of key 90 about the longitudinal axis.

FIG. 21 shows an embodiment similar to that of FIG. 20 except that a comb pivot spring assembly 120 having vertical springs 116 is secured to chassis 112 by fastening means such as rivets 118, spot welding, screws, etc. After assembly 120 is secured in place, keys 110 may then be assembled onto end sections 114 of the pivot springs 116.

What is claimed is:

1. A keyboard for a musical instrument comprising a plurality of elongated keys each having a longitudinal dimension, a bendable pivot spring for each key having second mating means, key bed means for rigidly holding one end section of each pivot spring, and each key having a chamber in a rear section defining a lower opening, said chamber having formed therein first mating means for receiving the second mating means of an associated pivot spring free of a separate fastening device between key and pivot spring, the first and second mating means being removably received rigidly one in the other whereby the pivot spring extends in a direction generally perpendicular to the key longitudinal dimension to form the sole rear (1) pivot, (2) biasing, (3) guidance and (4) support about which the key can rotate in a single plane only.

2. The keyboard of claim 1 in which the second mating means of each pivot spring has an upper opening having spring long dimension direction side walls and each chamber first mating means has an associated tab with side walls whereby the pivot spring opening receives the associated tab in an interference fit between tab side walls and spring opening side walls.

3. The keyboard of claims 1 or 2 in which each pivot spring has a flat upper end section having spring transversely directed shoulders and each key chamber has key transversely directed lower shoulders for receiving the associated spring shoulders to resist rotational movement of said key about the longitudinal axis and in other than said single plane.

4. The keyboard of claim 3 in which the side walls of the tab are tapered downwardly and inwardly of dimension to provide a rigid interference fit particularly at an upper portion between tab side walls and spring opening side walls.

5. The keyboard of claim 3 in which each key is formed entirely of plastic and each chamber tab is formed on a chamber rear wall free of an opening to the rear end of the key.

6. The keyboard of claim 3 in which said key bed means has a respective key bed opening for each pivot spring for receiving said lower section of said spring and a fastening device for securing said pivot spring to said key bed means.

7. The keyboard of claim 2 in which each pivot spring has an extended upper section which extends through an upper opening in said key whereby the extended section may be manually moved toward the front of the key to disengage the pivot spring opening from the associated tab in the key thereby permitting removal of the key.

8. The keyboard of claims 1, 2 or 4 in which said key bed means has a respective key bed opening for each pivot spring for receiving said lower section of said spring in a rigid force fit relation free of a separate fastening device between pivot spring and key bed means.

9. The keyboard of claim 8 in which each pivot spring has at said lower section transversely directed shoulders for rigidly engaging an upper surface of the key bed means adjacent the key bed opening.

10. The keyboard of claim 9 in which each pivot spring has at said lower section sloping shoulders respectively opposing the transversely directed shoulders whereby the sloping shoulders rigidly engage a lower surface of the key bed means adjacent the key bed opening.

11. The keyboard of claim 10 in which each said key bed opening is formed to define a downward extending key bed tab and in which the key bed opening has a reduced width section remote from said tab terminating in forward shoulders whereby a respective pivot spring is inserted at an angle into said key bed opening and forced to travel through an arc with spring shoulders engaging key bed surfaces thereby to provide a force fit of spring shoulders and surfaces of key bed means with the flat of the pivot spring against the tab shoulders.

12. The keyboard of claim 11 in which said tab shoulders and key bed opening are formed to rigidly hold the respective pivot spring at a substantially small angle short of the vertical away from the key front section thereby to preload the spring and retain the key front in an up position with key tab in spring opening and lower spring end against key bed tab.

13. The keyboard of claim 3 in which each of said keys has at least one downwardly extending key member, and in which there is provided for each key a switch unit having a deformable membrane adapted to be engaged by the associated key member, each switch unit including at least two electrical contacts adapted for movement into and out of electrical connection for completing a circuit therebetween.

14. The keyboard of claim 13 in which there is provided for each switch unit resilient material disposed between the switch unit and the key member for absorbing downward travel of the key member during actuation of the key thereby to avoid crushing of the contacts and deformable membrane.

15. The keyboard of claim 14 in which said resilient material is Poron.

16. The keyboard of claim 8 in which each pivot spring has at the lower section transversely directed shoulders and a reduced transversely directed portion extending from said transversely directed shoulders, said reduced transversely directed section bending away from the longitudinal dimension of said pivot spring for engaging a lower surface of the key bed means.

17. A key and pivot spring assembly for use in a musical keyboard instrument comprising, said pivot spring being flat over at least an upper section thereof, said key having a chamber formed in a rear section defining a lower opening in the key, said chamber having formed therein first mating means, the upper section of said pivot spring having second mating means, said first and second mating means being removably received one in the other for providing a force fit relation free of a separate fastening device between key and pivot spring whereby the pivot spring extends in a direction generally perpendicular to the key longitudinal dimension to form the sole pivot about which the key can rotate in a single plane only.

18. The assembly of claim 17 in which the second mating means of the pivot spring has an upper opening having side walls directed in a spring long dimension and the chamber first mating means has an associated tab with side walls whereby the pivot spring opening receives the tab in an interference fit between tab side walls and spring opening side walls.

19. The assembly of claims 17 or 18 in which the pivot spring has spring transversely directed shoulders and the key chamber has lower shoulders directed transversely of the key for receiving the associated spring shoulders thereby to resist rotational movement of the key about the key longitudinal axis whereby the pivot spring provides the sole rear support, sole rear guidance and sole biasing for said key.

20. The assembly of claim 19 in which the tab side walls are tapered downwardly and inwardly and are of dimension to provide a rigid force fit particularly at an upper portion of tab side walls and spring opening side walls.

21. The assembly of claim 20 in which the chamber of the key forms an upper opening in the key upper surface, the pivot spring has an extended upper end section which extends through the key upper opening whereby the extended spring section may be manually moved toward the front of the key to disengage the pivot spring opening from the key tab thereby permitting removal of the key.

22. The assembly of claim 19 in which there is provided key bed means having an opening for receiving the lower section of the spring in a rigid force fit relation free of a separate fastening device between pivot spring and key bed means.

23. The assembly of claim 22 in which the pivot spring has at the lower section transversely directed shoulders for rigidly engaging an upper surface of the key bed means.

24. The assembly of claim 23 in which the pivot spring has sloping shoulders which slope away from the transversely directed shoulders whereby the sloping shoulders rigidly engage a lower surface of the key bed means.

25. The assembly of claim 24 in which the key bed opening is formed to define a downward extending key bed tab and in which the key bed opening has a reduced width section remote from the tab and terminating in tab shoulders whereby the pivot spring is inserted into the key bed opening against the tab and forced to travel through an arc with shoulders engaging upper and lower surfaces of the key bed means thereby to provide a force fit of spring shoulders and upper and lower surfaces of the key bed means with the flat of the pivot spring against the tab shoulders.

26. The assembly of claim 17 in which there is provided key bed means having at least one opening for receiving outwardly extending sections of said spring assembly in a rigid locking relation free of a separate fastening device.

27. A keyboard for musical instrument comprising a plurality of elongated keys each having a longitudinal dimension, a flat pivot spring for each key, each key having a lower opening in a rear section for receiving an upper section of an associated pivot spring, key bed means having a respective key bed opening for each pivot spring for receiving a lower section of each spring in a rigid force fit relation free of a separate fastening device between pivot spring and key bed means, and each pivot spring having at the lower section transversely directed shoulders for rigidly engaging an upper surface of the key bed means adjacent the associated key bed opening, each pivot spring having at the lower section additional shoulders which slope away from the transversely directed shoulders whereby the sloping shoulders rigidly engage a lower surface of the key bed means adjacent the associated key bed opening.

28. The keyboard of claim 27 in which each key bed opening has a downwardly extending key bed tab and a reduced width section which tapers away from the tab and terminates in tab shoulders to provide a seat for the pivot spring when inserted into the key bed opening and when forced to travel through an arc with spring shoulders engaging key bed surfaces thereby providing a force fit of spring shoulders and key bed surfaces with the flat of the pivot spring finally seating hard against the tab shoulders.

29. The keyboard of claim 28 in which the tab shoulders and key bed opening are formed to rigidly hold the associated pivot spring at a substantially small angle less than the vertical away from the key front thereby to preload the pivot spring and retain the key front in an upward position with spring end against key bed tab.

30. The keyboard of claim 27 in which each pivot spring has a reduced transversely directed lower section extending from said transversely directed shoulders, said reduced transversely directed section bending away from the longitudinal dimension of said pivot spring for engaging a lower surface of the key bed means.

31. The keyboard of claim 30 in which said key bed opening has a center portion and leg openings extending rearwardly away from said center portion forming a U-shaped opening and a key bed tab, the lower surface of said key bed tab rigidly engaging the pivot spring at its reduced transversely directed section.

32. The keyboard of claim 31 in which said key bed tab is adjusted upwardly or downwardly to vary the preload bias on the pivot spring.

33. A key and pivot spring assembly for use in a musical keyboard instrument comprising, said pivot spring being flat over at least an upper section thereof, said pivot spring having within the upper section an upper opening having side walls directed in the spring long dimension, said key having a chamber formed in a rear section defining a lower opening in the key, the chamber having a tab with side walls whereby the upper opening within the spring upper section receives the tab in an interference fit between tab side walls and spring opening side walls free of a separate fastening device between key and pivot spring whereby the pivot spring extends in a direction generally perpendicular to the key longitudinal dimension to form the sole pivot about which the key can rotate in a single plane only.

34. The assembly of claim 33 in which the pivot spring has spring transversely directed shoulders and the key chamber has lower shoulders directed transversely of the key for receiving the associated spring shoulders thereby to resist rotational movement of the key about the key longitudinal axis.

* * * * *